US011510016B2

(12) United States Patent
Feilner et al.

(10) Patent No.: US 11,510,016 B2
(45) Date of Patent: Nov. 22, 2022

(54) BEAM FORMER CALIBRATION OF A HEARING DEVICE

(71) Applicant: Sonova AG

(72) Inventors: Manuela Feilner, Egg b. Zürich (CH); Amre El-Hoiydi, Neuchâtel (CH)

(73) Assignee: Sonova AG, Staefa (CH)

( * ) Notice: Subject to any disclaimer, the term of this patent is extended or adjusted under 35 U.S.C. 154(b) by 0 days.

(21) Appl. No.: 17/283,266

(22) PCT Filed: Oct. 8, 2018

(86) PCT No.: PCT/EP2018/077354
§ 371 (c)(1),
(2) Date: Apr. 7, 2021

(87) PCT Pub. No.: WO2020/074061
PCT Pub. Date: Apr. 16, 2020

(65) Prior Publication Data
US 2021/0385588 A1 Dec. 9, 2021

(51) Int. Cl.
*H04R 25/00* (2006.01)

(52) U.S. Cl.
CPC ..... *H04R 25/405* (2013.01); *H04R 25/70* (2013.01)

(58) Field of Classification Search
CPC ..... H04R 25/00; H04R 25/65
USPC ..... 381/312–313
See application file for complete search history.

(56) References Cited

U.S. PATENT DOCUMENTS

2005/0004801 A1* 1/2005 Liebermann ..... G10L 15/26 704/271
2005/0088435 A1 4/2005 Geng
2008/0192968 A1* 8/2008 Ho ..... H04R 25/405 381/313
2013/0169779 A1* 7/2013 Pedersen ..... G06V 40/10 348/E7.085
2017/0295442 A1* 10/2017 Mauler ..... H04R 25/405

FOREIGN PATENT DOCUMENTS

DE 102007005861 B3 8/2008
DE 102016205728 B3 7/2017

OTHER PUBLICATIONS

European Patent Office, International Searching Authority, International Search Report for PCT/EP2018/077354, dated May 28, 2019, Rijswijk, Netherlands.

* cited by examiner

*Primary Examiner* — Suhan Ni
(74) *Attorney, Agent, or Firm* — ALG Intellectual Property, LLC

(57) ABSTRACT

A method for adjusting a hearing device (12) adapted to be worn behind an ear (28) comprises: determining a cymba angle (54) between a cartilage (50) above the cymba (46) of the ear (28) and a viewing direction (38) of the user; estimating a tilt angle (39) of the hearing device (12) with respect to the viewing direction (38) from the cymba angle (54); and adjusting a beam former direction (37) of a beam former (34) of the hearing device (12), such that the beam former direction (37) is aligned with the viewing direction (38).

20 Claims, 3 Drawing Sheets

BEAM FORMER CALIBRATION OF A HEARING DEVICE

FIELD OF THE INVENTION

The invention relates to a method, a computer program and a computer-readable medium for adjusting a hearing device adapted to be worn behind an ear of a user. Furthermore, the invention relates to an adjusting system.

BACKGROUND OF THE INVENTION

Hearing devices are generally small and complex devices. Hearing devices can include a processor, microphone, loudspeaker, memory, housing, and other electronical and mechanical components. Some example hearing devices are Behind-The-Ear (BTE), Receiver-In-Canal (RIC), In-The-Ear (ITE), Completely-In-Canal (CIC), and Invisible-In-The-Canal (IIC) devices. A user can prefer one of these hearing devices compared to another device based on hearing loss, aesthetic preferences, lifestyle needs, and budget.

Many hearing devices worn behind the ear comprise two microphones to perform beamforming techniques. The tilt angle of the microphones relative to the horizontal plane may be used to calibrate the beam former. This tilt angle may be retrieved from a measurement of one dummy or manikin ear. The hearing device may be positioned on this dummy ear and the tilt angle may be measured. The measured tilt angle then may be introduced hard coded to all hearing devices with this housing.

However, when a user wears a hearing device behind the ear, the anatomy of the user's ear is also important for calibrating the beam former. For example, if the user's ear has an acute or obtuse angle, the angle of the beam former can be altered by not only the shape of the hearing device housing but also by the anatomy of the user's ear. Thus, there may be two angles that are important for beam forming computation: one measured based on the design and shape of the hearing device and another based on how the hearing device is positioned on the user's ear.

Measurements with the same housing of a hearing device on different ears have shown that the tilt angle of the hearing device varies a lot. Simulations with beam formers have shown that these tilt angles influence the beam former performance. A solution may be to directly measure the tilt angle of the hearing device on every end user, for example with a measurement tool attached to the hearing device. But a direct measurement of the tilt angle may be difficult and may be inconvenient for the user.

US 2005/0088435 A1 shows a 3D imaging device for making custom-fit hearing devices.

DESCRIPTION OF THE INVENTION

It is an objective of the invention to improve the beam former performance of a hearing aid. It is a further objective of the invention to facilitate the fitting of a hearing device.

These objectives are achieved by the subject-matter of the independent claims. Further exemplary embodiments are evident from the dependent claims and the following description.

A first aspect of the invention relates to a method for adjusting a hearing device adapted to be worn behind an ear of a user. The hearing device may be a hearing aid and/or may be adapted for compensating a hearing loss of the user. The hearing device may be a Behind-The-Ear-(BTE)-device and/or a Receiver-In-Canal-(RIC)-device.

According to an embodiment of the invention, the method comprises: determining a cymba angle between a cartilage above the cymba of the ear and a viewing direction of the user; estimating a tilt angle of the hearing device with respect to the viewing direction from the cymba angle; and adjusting a beam former direction of a beam former of the hearing device, such that the beam former direction is aligned with the viewing direction.

The concha of the ear is formed of the entrance ear channel, i.e. the cavum and the cymba, which is positioned above the cavum. Above the cymba, usually every ear has a cartilage, which protrudes from the ear and which is slanted with respect to a horizontal direction and/or viewing direction of the user. Experiments have shown that the tilt angles of a hearing device with the same housing are highly correlated with the angle of this cartilage with respect to the viewing direction of the user. Herein, this angle is called cymba angle.

The viewing direction of the user either may be defined by the eyes of the user, when the user looks in a horizontal direction. It also may be assumed that the viewing direction is horizontal, when the head of the user is aligned vertically.

The cymba angle may be determined by direct measurement or from one or more images of the ear of the user. This may be performed by a hearing aid specialist and/or automatically by a computer program evaluating the images. This computer program may be performed by an adjusting system, which receives the one or more images and/or image data for these images.

Usually, the cartilage above the cymba may not be straight, however, a direction of this cartilage may be determined by averaging a curve along this cartilage. The cymba angle then may be determined as the angle between the cartilage direction and the viewing direction.

The tilt angle then may be determined from the cymba angle, for example with the aid of a lookup table. It has to be noted that the tilt angle also may depend on further parameters, such as an ear size, a configuration of the hearing aid and/or glasses worn by the user. The tilt angle also ma depend on the length of a tube interconnecting the hearing aid part behind the ear and the one in the ear, which may be chosen by a hearing device specialist.

When the tilt angle is known, a beam former of the hearing aid may be adjusted, such that the direction, where the beam former has maximal amplification, is aligned with the viewing direction. The relationship between the tilt angle and the beam former direction may be determined from the arrangement of the microphones of the hearing device and/or the design of the housing of the hearing device.

In general, when the hearing devices acquire sound signals with its microphones, the beam former may be used to amplify sound from a specific direction, i.e. the beam former direction and/or to attenuate sound from another direction. With the method, the beam former direction can be aligned that a maximal amplification can be achieved in a direction that is substantially parallel to a viewing direction of the user. For example, it may be assumed that during a conversation, the user looks at the person he is speaking to.

The beam former direction may be adjusted by setting the parameters in the hearing device, which are used for controlling the beam former accordingly. These parameters may be set by an adjusting system, which is in data communication with the hearing device.

With the method, an improved beam former performance may be achieved and/or the process of the fitting the hearing device to the needs of the user may be improved. Furthermore, the method may facilitate and support a hearing device specialist.

According to an embodiment of the invention, the method further comprises: receiving image data from the ear, the image data containing at least one picture of the ear; and determining the cymba angle from the image data. One or more images of the ear of the user may be acquired with a camera. The image data of these images then may be sent to the adjustment system, which automatically may determine the cymba angle therefrom. For example, the camera may be part of a mobile device, such as a smartphone.

Image data may be data encoding an image with 2D pixels.

According to an embodiment of the invention, the cymba angle is determined with an image recognition algorithm adapted for identifying parts of the ear. The image recognition algorithm may determine the concha, the cymba, the helix and/or other parts of the ear. The image recognition algorithm may determine a curve, which runs along the cartilage above the cymba. From this curve and/or from specific points of the cartilage identified by the image recognition algorithm, the cymba angle may be determined.

According to an embodiment of the invention, the cymba angle is determined with a machine learning algorithm trained with image data of ears with known cymba angles. It also may be that a machine learning algorithm is trained with image data from many ears, where the cymba angles already have been determined manually.

According to an embodiment of the invention, the image data contains pictures of the ear from different directions and a three-dimensional representation is determined from the image data. Then, the cymba angle is determined from the three-dimensional representation. A three-dimensional representation of the ear may comprise points with three-dimensional coordinates modeling the ear. The cartilage above the cymba may be determined as protrusion in the three-dimensional representation. The three-dimensional representation may be determined from 2D image data acquired from different directions.

According to an embodiment of the invention, the image data contains a picture of a marker provided besides the ear, the marker having a scale and/or an indication of the viewing direction. It may be that a marker, such as a cartoon with symbols printed on it, is positioned besides the ear. For example, the marker may be hung on the ear. The marker may have a line aligned with the viewing direction. The marker may comprise a scale, such that the size of the ear and its parts can be determined.

According to an embodiment of the invention, the method further comprises: determining an ear size from the image data. Also the size of the ear may influence the tilt angle.

According to an embodiment of the invention, the method further comprises: determining a distance from a front of the helix of the ear to the entrance of the ear channel (i.e. the cavum) is determined from the image data. Such a distance may influence the tilt angle, in particular, when a length of a tube of the hearing device from a part behind the ear to a part in the ear is fixed.

According to an embodiment of the invention, the method further comprises: determining an optimal tube length of a tube interconnecting a part of the hearing device behind the ear with a part of the hearing device in the ear from the image data. For example, the optimal tube length may be determined from a distance from a front of the helix of the ear to the entrance of the ear channel. The tube length may be optimal in that the part behind the ear is positioned in such a way that an optimal amplification of the beam former may be achieved.

Otherwise, the determination of the tube length may be done with a cartoon by a hearing aid specialist and may be an extra effort for the hearing aid specialist. This extra step may be avoided by reading out the optimal tube length from the image data. Too short or too long tube lengths may lead to a deviation of the optimal tilt angle. The method therefore may propose the tube length and/or may incorporate the influence of the tube length into the calculation of the tilt angle.

According to an embodiment of the invention, the method further comprises: determining, whether the user wears glasses, from the image data. In the image data, also an arm of glasses may be visible, when such an arm is present, it may be deduced that the user wears glasses.

It has to be noted that the ear size, the distance of from a front of the helix of the ear to the entrance of the ear, the optimal tube length and/or the information, whether the user wears glasses, may be determined with an image recognition algorithm and/or with a machine learning algorithm.

According to an embodiment of the invention, the tilt angle is determined from the cymba angle and at least one of: an ear size, a selected tube length of a tube interconnecting a part of the hearing device behind the ear with a part of the hearing device in the ear, and information about, whether the user wears glasses or not. All these information and/or parameters may influence the relationship between the cymba angle and the tilt angle.

According to an embodiment of the invention, the tilt angle is determined from a lookup table. A lookup table may be provided in the adjusting system, from which a tilt angle can be determined. The lookup table may store the tilt angle in relation to the cymba angle and the above mentioned parameters.

According to an embodiment of the invention, the tilt angle is determined with a machine learning algorithm, which has been trained with known cymba angles. In general, the machine learning algorithm may have been trained with the cymba angle and the parameters mentioned above in relationship with the cymba angle and the above mentioned parameters.

Further aspects of the invention relate to a computer program for adjusting a hearing device, which, when being executed by a processor, is adapted to carry out the steps of the method as described in the above and in the following as well as to a computer-readable medium, in which such a computer program is stored.

For example, the computer program may be executed in a processor of an adjusting system, which may be in data communication with the hearing device. The computer-readable medium may be a memory of this adjusting system.

In general, a computer-readable medium may be a floppy disk, a hard disk, an USB (Universal Serial Bus) storage device, a RAM (Random Access Memory), a ROM (Read Only Memory), an EPROM (Erasable Programmable Read Only Memory) or a FLASH memory. A computer-readable medium may also be a data communication network, e.g. the Internet, which allows downloading a program code. The computer-readable medium may be a non-transitory or transitory medium.

A further aspect of the invention relates to an adjusting system, which is adapted for performing the method as described in the above and below. The adjusting system may be or may comprise a mobile device, such as a mobile phone, a tablet computer, etc. The adjusting system also may be or may comprise a personal computer of a hearing aid specialist.

It has to be understood that features of the method as described in the above and in the following may be features of the computer program, the computer-readable medium and the adjusting system as described in the above and in the following, and vice versa.

These and other aspects of the invention will be apparent from and elucidated with reference to the embodiments described hereinafter.

BRIEF DESCRIPTION OF THE DRAWINGS

Below, embodiments of the present invention are described in more detail with reference to the attached drawings.

The reference symbols used in the drawings, and their meanings, are listed in summary form in the list of reference symbols. In principle, identical parts are provided with the same reference symbols in the figures.

DETAILED DESCRIPTION OF EXEMPLARY EMBODIMENTS

Figure 1:
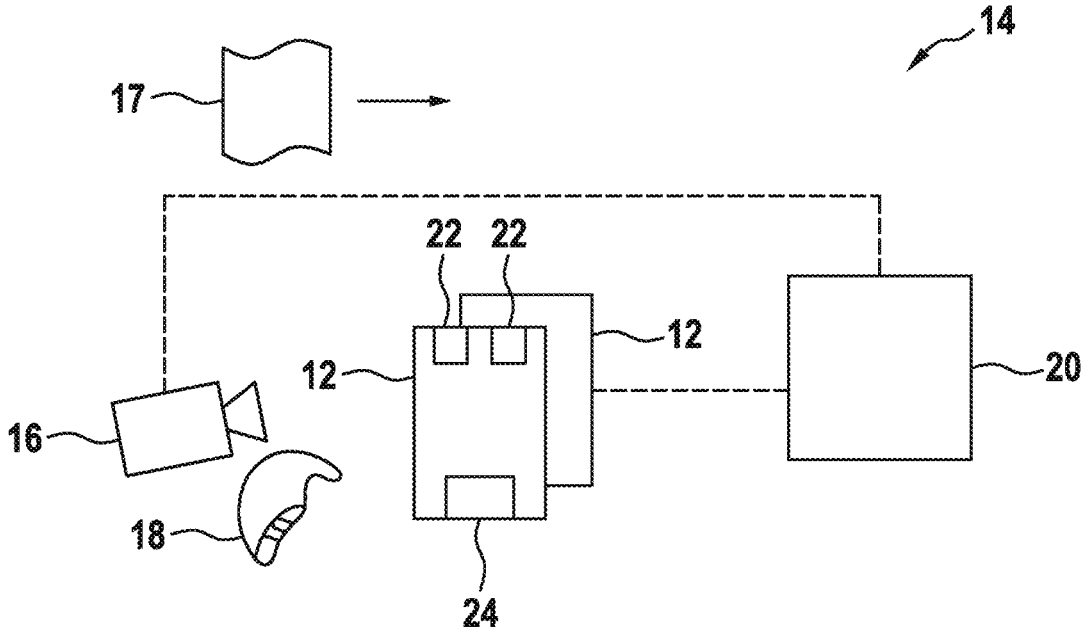
FIG. 1 schematically shows an adjusting system according to an embodiment of the invention.

FIG. 1 schematically shows two hearing devices 12 and an adjusting system 14, which is used for adjusting the hearing devices 12 and in particular a beam former of these hearing devices 12. Usually, a user wears a hearing device 12 for each ear. In the following, only reference to one of these hearing devices 12 is made. However, both hearing devices may be adjusted as described herein.

The adjusting system 14 may comprise a camera 16, which is used for acquiring images and/or image data 17 of the ear and/or a marker 18, such as a cartoon strip, which comprises a scale and/or indicators for a viewing direction of the user. Furthermore, the adjusting system 14 may comprise a computing unit 20, which automatically may determine control parameters for the hearing device 12 from the images/the image data 17. The adjusting system 14 may establish data communication with the hearing device 12 and may implement the control parameters in the hearing device 12.

Figure 2:
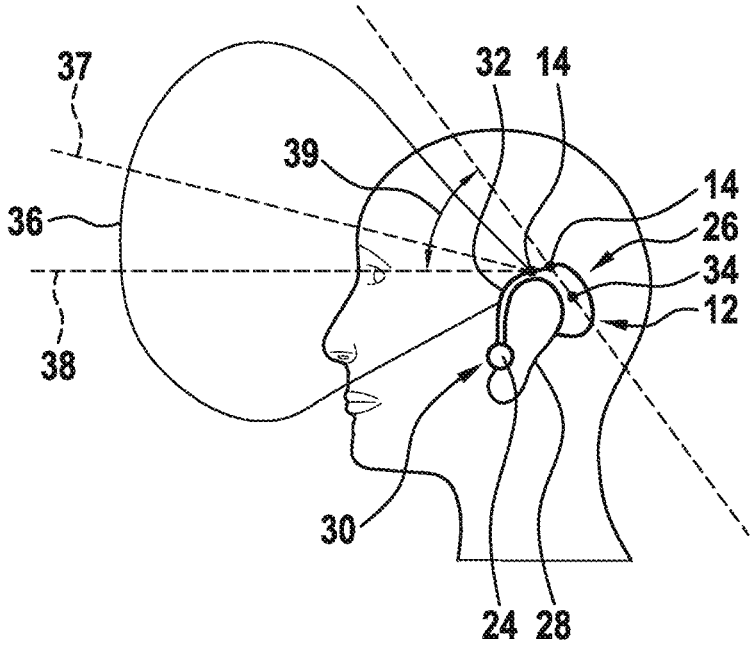
FIG. 2 schematically shows a hearing device with a beam former.

The hearing device 12 comprises at least two microphones 22 and a loudspeaker 24, which are also shown in FIG. 2.

As shown in FIG. 2, the hearing device comprises a part 26, which is worn behind the ear 28 and a part 30, which is in the entrance of the ear channel (cavum). Both parts 26, 30 are interconnected with a tube 32.

The part 26 carries the microphones 22 and further electronics, which provide a beam former 34 as described above and below.

It may be that the loudspeaker 24 is situated in the part 26. In this case, the tube 32 may be a sound conductor into the ear channel. It also may be that the loudspeaker 24 is provided in the part 30. In this case, the tube 32 may house a line for transmitting signals to the loudspeaker 24.

FIG. 2 furthermore schematically shows with an amplification curve 36, how the beam former 34 amplifies sound from a specific direction, i.e. the viewing direction 38 of the user and attenuates sounds from other directions. The beam former 34 has a beam former direction 37, in which the amplification is maximal. At best, the direction 37 of the beam former should be parallel to the viewing direction 38. However, for adjusting the direction 37 of the beam former 34, a tilt angle 39 of the hearing device 12 has to be known, since the positions of the microphones 22 depend on the tilt angle 39. The tilt angle 39 depends on the form of the ear 28 and the position on the ear 28, where the part 26 of the hearing device 12 is worn.

Figure 3:
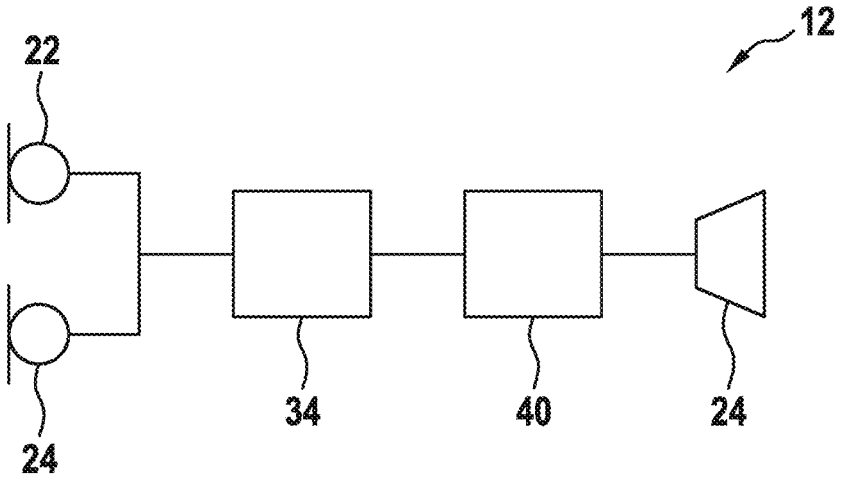
FIG. 3 schematically shows a functional diagram of a hearing device.

FIG. 3 schematically shows a functional diagram of a hearing device 12. The hearing device 12 has a beam former 34, which receives sound signals from the microphones 22 and a further processing unit 40, which, for example, may amplify the beam formed sound signal frequency dependent to compensate a hearing loss of the user. The processed sound signal is then output by the loudspeaker 24.

The components 34 and 40 of the hearing device 12 may be implemented as software modules in the hearing device 12, which may comprise a processor for executing these modules.

The direction and angle width of the beam former 34 may be set and/or adjusted with control parameters that are stored in the hearing device 12.

Figure 4:
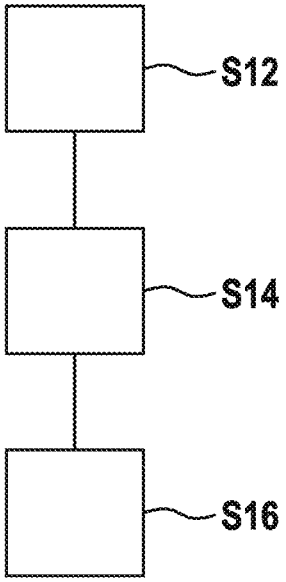
FIG. 4 shows a method for adjusting a hearing device according to an embodiment of the invention.

FIG. 4 shows a method for adjusting these control parameters, such that the direction 37 of the beam former 34 is optimally aligned with the viewing direction 38 of the user. These directions may be optimally aligned, when they are substantially parallel.

In step S12, a cymba angle 54 between a cartilage 50 above the cymba 46 of the ear 28 and a viewing direction 38 of the user is determined.

Figure 5:
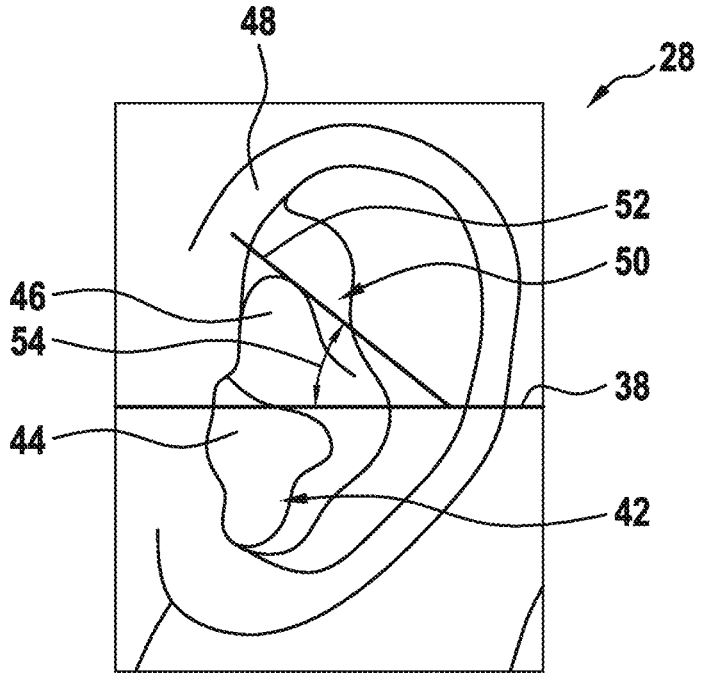
FIG. 5 shows components of an ear.

A definition of the cymba angle is given with respect to FIG. 5, which shows components of an ear 28. The ear 28 comprises an ear conch or concha 42, which is divided into the entrance to the ear channel or cavum 44 and the cymba 46. The cymba 46 may be seen as a depression above the cavum 44, which is separated from the cavum by a part of the helix 48 of the ear 28.

The ear 28 has a cartilage 50 arranged above the cymba 46, which is slanted with respect to the viewing direction 38. The cartilage 50, which may be called "rook", is related to the anatomy behind the ear 28 and influences how the part 26 of the hearing device 12 is positioned behind the ear 28. To this cartilage 50, a cartilage direction 52 may be associated, which may run along a longitudinal extension of the cartilage 50.

The cymba angle 54 is determined as the angle between the cartilage 50 and/or the cartilage direction and the viewing directing 38, which may be defined as the horizontal axis of the head, when an elevation of the head is 0 degree.

Experiments have shown that the larger cymba angle 54, the larger the tilt angle 39.

Figure 6:
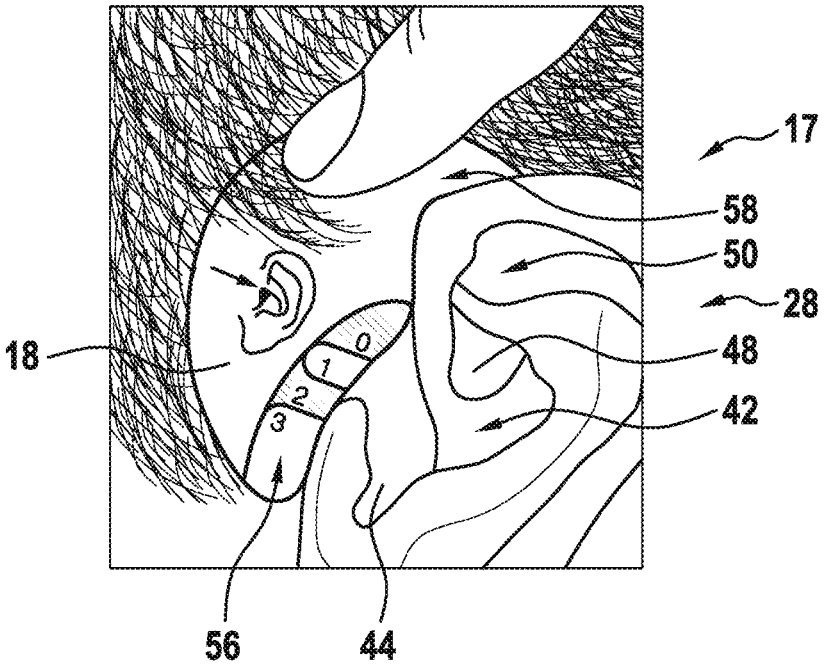
FIG. 6 shows an image used in the method of FIG. 4.

The cymba angle 54 may be determined from a picture, an image or image data 17 of the ear 8, such as shown in FIG. 6.

FIG. 6 furthermore shows that a marker 18 with a scale 56 and an indicator 58 for the viewing direction 38 may be positioned besides the ear for facilitating the determination of the cymba angle 54 and further parameters. The marker 18 may be a cartoon and/or may be used to choose an optimal tube length. The labels (0-3) on the marker 18 may correspond with the labels of the different available sizes for tubes.

For example, a hearing aid specialist may position the marker 18 at the ear 28 and may take one or more pictures with the camera 16, which then sends the image data 17 to the computing unit 20. As an example, the camera 16 may be a component of a smartphone. The computing unit 20 then receives the image data 17 from the ear 28 and automatically determines the cymba angle 54 from it.

The images and/or image data 17 may be acquired with a software that may give the photographer feedback to take qualitative usable pictures. A predefined symbol of a potential ear on a display, which also shows the actual image of the camera 16, may show to the photographer, how to place the camera 16. There also may be a visual feedback on the camera while taking the picture, which shows whether the extract of the view of the ear is correct. Also, a message may be provided, from which the photographer gets informed whether too many hairs cover the ear. This feedback may be given visually by detecting the hairs and highlighting them.

It also may be that the software may be adapted for being used by the user of the hearing device 12 himself. If the user is taking a photo from himself, the software may help to get an accurate extract by guiding him with acoustic notifications (such as voice messages or beep tones) to the right location of his hand.

Furthermore, as soon as the position of the camera 16 is correct, the picture and/or the image data 17 may be acquired automatically, for example without any interaction of the photographer (see also "automatic release" below). When the extract and/or frame of picture is usable, a display of the camera may turn green to signalize the photographer to acquire the picture and/or may capture the picture itself.

It may be that the image data 17 contains pictures of the ear 28 from different directions and that a three-dimensional representation is determined from the image data 17. The cymba angle 54 may be determined from the three-dimensional representation. With posing the camera 16 around the ear, a 3D scan may be performed. Also, a 3D image processing algorithm may be applied, which may capture the room information, such as an angle from the camera 16 to the head, the elevation of the head, the size relations of components of the ear 28, etc.

As already mentioned, also a marker 18 may have been positioned besides the ear 28 and the image data 17 may contain a picture of a marker 18. Also from this marker, the angle from the camera 16 to the head, the elevation of the head, the size relations of components of the ear 28, etc. may be determined.

The marker 18 may be a cartoon as shown in FIG. 6 and/or may be a sticker close to the ear 28 with known size and within the horizontal plane of for example the notch of the ear.

A mobile device, such as a smartphone, which provides the camera 16, also may display augmented reality images to show the user, how the hearing device 12 may look like in dependence of different parameters. For example, different hearing devices 12 with different housings and/or with longer and shorter tubes 32 may be projected into the image 17. Also, for the current configuration, a beam former performance may be added in form of a description (excellent, good, poor, . . . ) and/or color labels (green, orange, red).

There are several possibilities how the cymba angle 54 may be determined by the computing unit 20.

For example, an image recognition and/or image processing algorithm may identify at least some of the parts 42, 44, 46, 48, 50 of the ear 28.

Alternatively or additionally, the cymba angle 54 may be determined with a machine learning algorithm, which has been trained with image data 17 of ears 28, where the cymba angles 54 were known.

During the step S12, also further parameters, which may be useful during the next step S14, in which the tilt angle 39 is determined, may be determined.

For example, an ear size may be determined from the image data 17. As a further example, a distance from a front of the helix 48 of the ear 28 to the ear channel 44 may be determined from the image data 17. Here, the marker 18 with the scale 56 and/or a 3D scan may be used, in which the size of different parts of the ear 28 may be estimated.

Furthermore, an optimal tube length of a tube 32 interconnecting a part 26 of the hearing device 12 behind the ear 28 with a part 30 of the hearing device 12 in the ear 28 may be determined from the image data 17. This tube length may be determined from the distance mentioned above.

It may be that different tube lengths are offered by the method, for example, the method may determine that a tube with length "2" or "3" or "2.5" may be needed.

Also, a hearing aid specialist may enter, which length of the tube 32 has been chosen, for example one of the proposed different lengths. The method then may recognize, whether the length is longer or shorter or exact than the actual size of the user's anatomy, i.e. the distance determined above.

Furthermore, during step S12, it may be determined, whether the user wears glasses. This may be done with the image data 17, for example automatically by the image recognition algorithm and/or the machine learning algorithm. Alternatively, a hearing aid specialist may enter the information manually and/or via a conversational user interface, whether the user is wearing glasses or not.

Also, the type of hearing device may be determined during step S12. For example, a hearing aid specialist may enter this information into the adjusting system 14. Alternatively, the adjusting system 14 may detect the type of hearing device 12, for example via data communication with the hearing device 12.

In step S14, a tilt angle 39 of the hearing device 12 with respect to the viewing direction 38 is estimated from the cymba angle 54 and optional further data determined during step S12. The tilt angle 39 may be determined from the cymba angle 54 and at least one of: an ear size, a selected tube length of a tube 32 interconnecting a part 26 of the hearing device 12 behind the ear 28 with a part 30 of the hearing device 12 in the ear 28 and information about, whether the user wears glasses or not.

The tilt angle 39 may be determined from a lookup table. A database with measurements of resulting tilt angles dependent on the defined parameters may comprise such a lookup table. Between the discrete data points of the lookup table, the method may interpolate between the two nearest entry points of the lookup table.

It also may be that the tilt angle 39 is determined with a machine learning algorithm, which has been trained with known cymba angles 54 and/or further parameters. The machine learning algorithm may be trained offline with data such as determined during step S12 and matching tilt angles 39.

It also may be that a 3D scan is performed with the camera 16, after the hearing device 12 has been put on the ear 28.

The tilt angle of the microphones 22 may then be calculated directly while the hearing device 12 is on the ear 28.

In step S16, a beam former direction 37 of the beam former 34 of the hearing device 12 may be adjusted, such that the beam former direction 37 is aligned with the viewing direction 38.

For example, dependent on the tilt angle, the adjusting system 14 may determine the control parameters of the beam former 34, such that its direction is in parallel with the viewing direction 38. These control parameters may be implemented in the hearing device 12 via data communication.

It also may be that the adjusting system 14 provides feedback to chosen hearing devices 12 and/or chosen length of the tube 32.

For example, if the tilt angle 54 is very disadvantageous to the beam former performance, the adjusting system 14 may advise the hearing aid specialist to choose a shorter tube length. If the hearing aid specialist does so and enters another tube length he has chosen, the tool may determine the tilt angle 39 and/or the control parameters based on this choice.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art and practising the claimed invention, from a study of the drawings, the disclosure, and the appended claims. In the claims, the word "comprising" does not exclude other elements or steps, and the indefinite article "a" or "an" does not exclude a plurality. A single processor or controller or other unit may fulfill the functions of several items recited in the claims. The mere fact that certain measures are recited in mutually different dependent claims does not indicate that a combination of these measures cannot be used to advantage. Any reference signs in the claims should not be construed as limiting the scope.

LIST OF REFERENCE SYMBOLS

12 hearing device
14 adjusting system
16 camera
18 marker
20 computing unit
22 microphone
24 loudspeaker
26 part behind the ear
28 ear
30 part in the entrance of the ear channel
32 tube
34 beam former
36 amplification curve
37 beam former direction
38 viewing direction
39 tilt angle
40 processing unit
42 concha
44 cavum
46 cymba
48 helix
50 cartilage
52 cartilage direction
54 cymba angle
56 scale
58 indicator for viewing direction

The invention claimed is:

1. A method for adjusting a hearing device adapted to be worn behind an ear of a user, the method comprising:

receiving image data from the ear, the image data containing at least one image of the ear;

determining, from the image data, a cymba angle between a cartilage above a cymba of the ear and a viewing direction of the user, wherein a direction of the cartilage is determined by averaging a curve along the cartilage and the cymba angle is determined as an angle between the direction of the cartilage and the viewing direction;

estimating a tilt angle of the hearing device worn by the user with respect to the viewing direction from the cymba angle;

adjusting a beam former direction of a beam former of the hearing device, such that the beam former direction is aligned with the viewing direction.

2. The method of claim 1, wherein the cymba angle is determined with an image recognition algorithm adapted for identifying parts of the ear.

3. The method of claim 1, wherein the cymba angle is determined with a machine learning algorithm trained with image data of ears with known cymba angles.

4. The method of claim 1, wherein the image data contains images of the ear from different directions and a three-dimensional representation is determined from the image data;

wherein the cymba angle is determined from the three-dimensional representation.

5. The method of claim 1, wherein the image data contains an image of a marker provided besides the ear, the marker having at least one of a scale or an indication of the viewing direction.

6. The method of claim 1, further comprising:

determining an ear size from the image data;

wherein a distance from a front of a helix of the ear to an ear channel is determined from the image data.

7. The method of claim 1, further comprising:

determining an optimal tube length of a tube interconnecting a part of the hearing device behind the ear with a part of the hearing device in the ear from the image data.

8. The method of claim 1, further comprising:

determining, whether the user wears glasses, from the image data.

9. The method of claim 1, wherein the tilt angle is determined from a lookup table.

10. The method of claim 1, wherein the tilt angle is determined with a machine learning algorithm, which has been trained with known cymba angles.

11. The method of claim 1, wherein the tilt angle is determined from the cymba angle and at least one of:

an ear size, a selected tube length of a tube interconnecting a part of the hearing device behind the ear with a part of the hearing device in the ear, information about, whether the user wears glasses or not.

12. A non-transitory computer-readable medium storing instructions, which when executed by a processor, cause a hearing system to perform operations, the operations comprising:

receiving image data from an ear of a user, the image data containing at least one image of the ear;

determining, from the image data, a cymba angle between a cartilage above a cymba of the ear and a viewing direction of the user, wherein a direction of the cartilage is determined by averaging a curve along the cartilage and the cymba angle is determined as an angle between the direction of the cartilage and the viewing direction;

estimating a tilt angle of the hearing device worn by the user with respect to the viewing direction from the cymba angle;

adjusting a beam former direction of a beam former of the hearing device, such that the beam former direction is aligned with the viewing direction.

13. The non-transitory computer-readable medium of claim 12, wherein the cymba angle is determined with an image recognition algorithm adapted for identifying parts of the ear.

14. The non-transitory computer-readable medium of claim 12, wherein the cymba angle is determined with a machine learning algorithm trained with image data of ears with known cymba angles.

15. The non-transitory computer-readable medium of claim 12, wherein the image data contains images of the ear from different directions and a three-dimensional representation is determined from the image data;

wherein the cymba angle is determined from the three-dimensional representation.

16. The non-transitory computer-readable medium of claim 12, wherein the image data contains an image of a marker provided besides the ear, the marker having at least one of a scale or an indication of the viewing direction.

17. The non-transitory computer-readable medium of claim 12, further comprising:

determining an ear size from the image data;

wherein a distance from a front of a helix of the ear to an ear channel is determined from the image data.

18. The non-transitory computer-readable medium of claim 12, further comprising:

determining an optimal tube length of a tube interconnecting a part of the hearing device behind the ear with a part of the hearing device in the ear from the image data.

19. The non-transitory computer-readable medium of claim 12, further comprising:

determining, whether the user wears glasses, from the image data.

20. The non-transitory computer-readable medium of claim 12, wherein the tilt angle is determined from a lookup table.

* * * * *